United States Patent [19]

Simmons

[11] 4,002,293

[45] Jan. 11, 1977

[54] METHOD AND APPARATUS FOR SHAPING AND POSITIONING FLUID DISPERSAL PATTERNS

[76] Inventor: Thomas R. Simmons, 3510 Lobit, Dickinson, Tex. 77027

[22] Filed: Mar. 13, 1974

[21] Appl. No.: 450,549

Related U.S. Application Data

[63] Continuation-in-part of Ser. No. 349,252, April 9, 1973, abandoned.

[52] U.S. Cl. ..... 239/11; 239/17; 239/421; 239/545

[51] Int. Cl.[2] ..... B05B 1/26

[58] Field of Search ..... 239/11, 12, 17, 421, 239/512, 543–545

[56] References Cited

UNITED STATES PATENTS

| | | | |
|---|---|---|---|
| 2,542,761 | 2/1951 | Fogler | 239/421 |

FOREIGN PATENTS OR APPLICATIONS

| | | | |
|---|---|---|---|
| 588,815 | 2/1925 | France | 239/545 |
| 302,628 | 10/1965 | Netherlands | 239/421 |
| 621,785 | 4/1949 | United Kingdom | 239/421 |
| 17,369 | 1892 | United Kingdom | 239/545 |

*Primary Examiner*—Robert S. Ward, Jr.
*Attorney, Agent, or Firm*—Bard, Springs & Jackson

[57] ABSTRACT

Methods and apparatus are provided for use in decorative water fountains, dish washers, and the like, wherein one or more pairs of oppositely projected fluid streams are collided to form dispersals having preselected shapes and movement or location functionally related to the relative magnitude, pressure or impact velocity, and alignment of the streams.

18 Claims, 12 Drawing Figures

FIG. 1
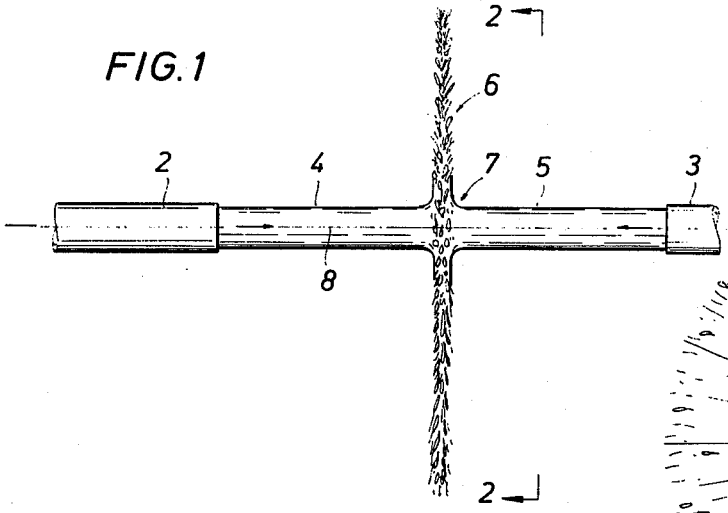
FIG. 2
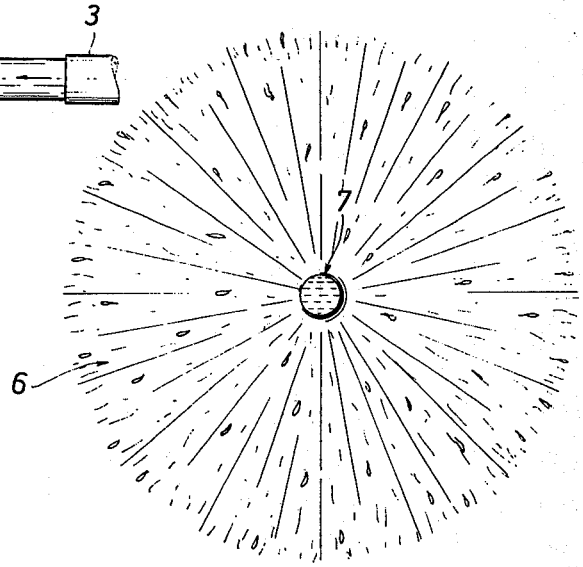
FIG. 3
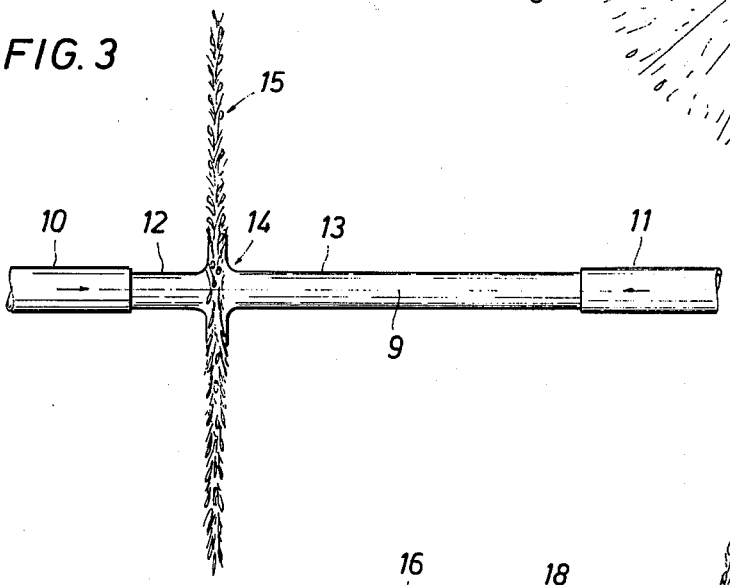
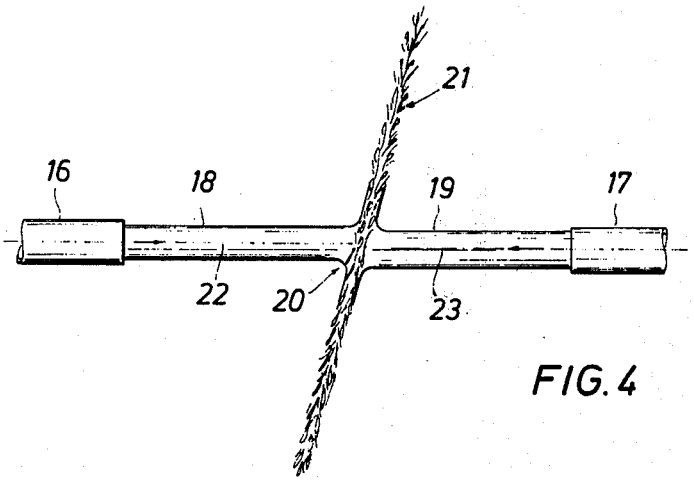
FIG. 4
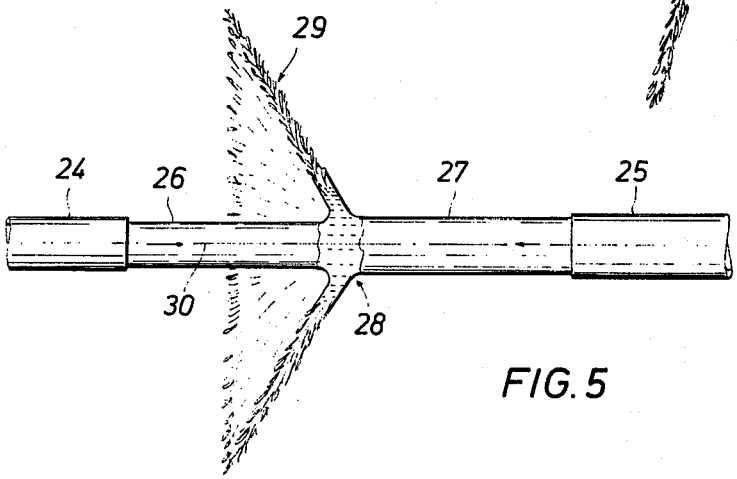
FIG. 5

METHOD AND APPARATUS FOR SHAPING AND POSITIONING FLUID DISPERSAL PATTERNS

RELATED CASES

This is a continuation-in-part of the co-pending patent application Ser. No. 349,252, which was filled Apr. 9, 1973 and which is now abandoned.

BACKGROUND OF INVENTION

This invention relates to methods and apparatus for producing and manipulating liquid sprays of various configurations and, more particularly, relates to methods and apparatus for producing and manipulating such sprays for both utilitarian and esthetic purposes. Specifically, means and methods are provided for use in a decorative water fountain wherein one or more liquid sprays of different configuration are produced and manipulated in an unusual and spectacular manner.

It is well known that the presence of a waterfall or flowing creek or stream usually tends to have a distinct beneficial effect on the physical environment. Insofar as humans are concerned, however, the greater benefit is often largely psychological in character, and thus water fountains are commonly constructed and enjoyed not only in public parks and the like, but also in commercial and private residential areas. These fountains are of many different types and designs and employ one or more different combinations of gravity and pressured flows such as cascades and continuous or intermittent sprays.

With respect to fountain sprays, it will be noted that greater esthetic appeal tends to be obtained with variety. Accordingly, fountains have been designed and built wherein two or more jets or pressured streams are arranged in various geometric patterns with respect to each other and are directed in various directions whereby the resulting effect is an extremely pleasing spectacle. In addition, the sprays may be formed in the manner of fingers, cones, fans, etc., by the use of nozzles of different well known configurations. Also, both the height and the occurrence of such sprays may be varied in both a regular as well as a random manner by interrupting or varying the pressures of the streams, whereby either a "dancing" or a geyser-like effect may be produced as desired.

SUMMARY OF INVENTION

In the present invention, novel methods and apparatus are provided wherein two free traveling streams or jets of water or the like are projected into a collision with each other to effect dispersal at the point of intersection or collision according to a preselected configuration. If the two streams are of equal cross-sectional size and pressure, and if they are directed against each other along the same path, the dispersal pattern will be circular in shape and substantially perpendicular to the path of the streams. Furthermore, the point of collision will be substantially midway between the points of origin of the two streams.

If the pressure of one of two such diametrically opposed streams is greater than the other, then the point of their collision will be nearer the origin point or nozzle of the stream of lower pressure, although the dispersal pattern will nevertheless be circular and perpendicular to the path of the streams. Thus, the dispersed stream may be caused to move back and forth between the two opposing nozzles or ejection ports by selectively varying the pressures on the two streams.

If the cross-sectional size or areal extent of one stream is larger than that of its opposing stream, then the dispersal pattern will tend to be conical rather than disc-like, with the apex of the cone aimed along the path in the direction of the nozzle or point of origin of the stream having the larger cross section. If the cross section of one stream is decreased as the cross section of the other stream is increase, the bell of the conelike dispersal may be "folded back" along the path of the two streams until the apex of the cone is aimed in an opposite direction.

It should be noted that the shape of the dispersal pattern depends on the relative cross sections of the two streams, whereas the location of the dispersal between two opposing streams depends upon the differential between their two pressures. It should further be noted, however, that as used herein the term "pressure" really means the velocity of the water or fluid after it is ejected from a nozzle or port to form a free traveling stream traveling in midair.

The path of the two opposed streams may be horizontal or vertical, or even tilted at an angle with respect to the earth, provided they are ejected under pressures great enough to negate the force of gravity. Accordingly, two or more pairs of opposed streams may be arranged in a variety of configurations, and controlled according to a variety of programs, to provide a variety of interesting displays.

As hereinbefore stated, the methods and apparatus of the present invention may also be applied to utilitarian purposes. In particular, dish washing apparatus may be provided wherein opposing streams collide at locations such that dispersal occurs adjacent surfaces to be cleansed and rinsed. In addition, pressure may be varied to travel the dispersal patterns across such surfaces to enhance their scouring effect, and the relative cross sections of the streams may be varied to direct dispersal into less accessible portions of the cleaning chamber containing such dishes.

It is an essential feature of this invention that the liquid streams which are opposed to produce the desired dispersal pattern be collimated or cylindrical in form, and that they be substantially non-aerated or free of gas. If the colliding streams have such a configuration, however, their collision will produce dispersal patterns which are also non-aerated and which do not tend to break apart except at their perimeters, where the force of gravity begins to exceed the force of the collision. Many types of nozzles or other ejection means can be used for producing suitably formed streams, such as a simple section of pipe or tubing or the like, since it is only necessary that the output stream contain no significant amount of air or other gas which might tend to disperse the stream for its collision with another stream of like configuration but opposite direction, and also that the two streams retain their cylindrical configuration up to the point of collision.

This feature of the present invention may be better understood by a comparison with methods and apparatus of the prior art such as described in the British patent No. 621,785, wherein there are also provided opposing streams of liquid which collide to form a desired dispersal pattern. The object of the invention sought to be covered by this British patent is, however, to provide a system which produces disintegration or "pulverization" of the liquid to provide enhanced atomization of the liquid into discrete particles or droplets to form a mist. Accordingly, in the British patent the confronting nozzles are selected to produce cone-like sprays which, when they collide or otherwise interact, tend to further disperse in droplet form. Thus, the invention in the British patent not only employs nozzles adapted to eject each stream of liquid in a diverging cone-like form which tends to separate into discrete droplets, but which preferably ejects such streams in aerated form so as to facilitate such separation or atomization. Accordingly, when two such streams are directed against each other, the result which is intended and achieved is a further separation of the liquid into discrete particles tending to be discharged in all directions.

In the present invention, separation is negated or minimized by discharging the two opposing "solid" or substantially solid streams of liquid in a cylindrical or substantially cylindrical configuration from the nozzles to their point of collision with each other. If the streams are kept free of an appreciable amount of air or other gas, the result will be a circular dispersal of liquid which will also be substantially "solid" or non-aerated, except at its perimeter where the effect of gravity will cause the liquid at the edge of the dispersion to separate and fall away in the form of droplets as hereinbefore explained.

These and other features and advantages of the present invention will become apparent from the following detailed description, wherein reference is made to the accompanying drawings.

In the drawings:

FIG. 1 is a simplified functional representation of an embodiment of the present invention as exemplified by a pair of oppositely projected free traveling fluid streams of substantial magnitude colliding to form a perpendicular pattern of dispersal.

FIG. 2 is a simplified functional representation of another view of the dispersal pattern illustrated in FIG. 1 and depicting its radial or circular configuration.

FIG. 3 is another simplified functional representation of the streams depicted in FIG. 1, wherein one stream has a velocity greater than the velocity of the other stream.

FIG. 4 is a further simplified functional representation of the streams depicted in FIGS. 1–3, but wherein one stream is displaced from its alignment with the other stream.

FIG. 5 is another simplified functional representation of the streams depicted in FIGS. 1–3, but wherein one stream has a greater cross section or areal magnitude than the other stream.

DETAILED DESCRIPTION

Figure 7:
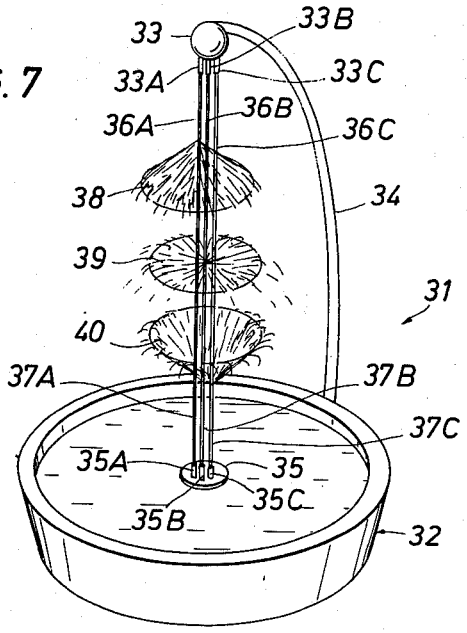
FIG. 7 is a simplified pictorial representation of a decorative fountain or the like employing an arrangement of oppositely disposed and colliding fluid streams according to the concept illustrated in FIG. 6.

Referring now to FIGS. 1 and 2, there may be seen a simplified functional representation of basic apparatus employing the concept of the present invention, such apparatus including a first discharge means or nozzle 2 preferably having the form of a tube and arranged in confronting relationship to a second discharge means or nozzle 3 preferably of the same type. More particularly, it may be seen that the first nozzle 2 delivers a pressured stream or jet of water 4 which collides with a corresponding stream 5 from the other nozzle 3 and, at the point of collision 7, produces a substantially non-aerated dispersal having a radial configuration perpendicular to the axis 8 of the streams 2 and 3. It is a feature of this invention that if the velocities of the two streams 4 and 5 are substantially equal, and if their cross-sectional areas are substantially equal in size, the point of collision 7 will be located approximately midway between the tips of the nozzles 2 and 3. In addition, if the two streams 4 and 5 are both disposed in alignment coaxially with the common axis 8, the dispersal 6 will be perpendicular with respect to the streams 4 and 5.

The cross-sectional shape of the streams 4 and 5 is substantially immaterial to the concept of the present invention. As indicated in FIG. 2, the streams 4 and 5 may be circular in cross-sectional configuration, but they may also be of some other shape as may be desired for some other reason.

As hereinbefore suggested, the location of the point of collision 7 depends upon the magnitude of any difference existing between the velocities of the two srreams 4 and 5. Referring now to FIG. 3, which shows similar apparatus comprising nozzles 10 and 11 delivering coaxially aligned streams 12 and 13, it will be noted that the collision point 14 is shifted from mid-way to a point adjacent the tip of nozzle 10 because the stream 13 from nozzle 11 issues at a higher velocity than that of stream 12 issuing from the other nozzle 10. Since the streams 12 and 13 are of equal cross section, and since they are both aligned with the axis 9, however, it will be noted that the dispersal 15 is nevertheless radial in configuration and perpendicular to the axis 9.

Referring now to FIG. 4, there may be seen a different arrangement wherein nozzle 16, which produces a stream 18 along axis 22, is directed against a stream 19 which issues along axis 23 from a confronting nozzle 17. In this arrangement, axis 22 is slightly misaligned with respect to axis 23, and thus the dispersal 21 is tilted angularly at the point of collision 20 as a result of such misalignment. Accordingly, it will also be apparent that the size of such angular tilt will be direct function of the spacing between the axes 22 and 23, and also the direction in which such misalignment occurs.

Referring now to FIG. 5, there may be seen a different arrangement wherein nozzle 24 is of a smaller diameter than nozzle 25, whereby the stream 26 issuing from nozzle 24 is of a smaller cross-sectional area than the stream 27 issuing from nozzle 25. Accordingly, the dispersal 29, though still circular in configuration, tends to be conical in shape with the end flaring in the direction of the nozzle 24 having a smaller diameter.

Referring again to FIG. 4, it will be noted that although the dispersal 21 is tilted relative to the axes 22 and 23, the point of collision 20 between the two streams 18 and 19 is still substantially mid-way between the two nozzles 16 and 17 since the velocities of the two streams 22 and 23 are substantially equal to each other. Similarly, although the dispersal 29 in FIG. 5 is conical rather than disc-like, as is the case in FIGS. 1–4, the collision point 28 between the two streams 26 and 27 is nevertheless mid-way between the nozzles 24 and 25 because the velocities of the streams 26 and 27 are equal. Accordingly, it will be apparent that the velocities of the streams 18 and 19 in FIG. 4 may be varied with respect to each other, and that the collision point 20 may thus be oscillated or moved in either or both directions along axes 22 and 23. Similarly, the spacing between the two axes 22 and 23 may be varied, as desired, whereby the dispersal 21 may be tilted to an even greater angle or even restored to vertical.

Referring again to FIG. 5, it will be apparent that the collision point 28 may be shifted from mid-way by varying the velocities of streams 26 and 27. In addition, however, means may be provided as hereinafter described for varying the relative cross sections of these two streams 26 and 27, whereby the direction of flare of the dispersal 29 may be shifted back and forth as desired.

Figure 6:
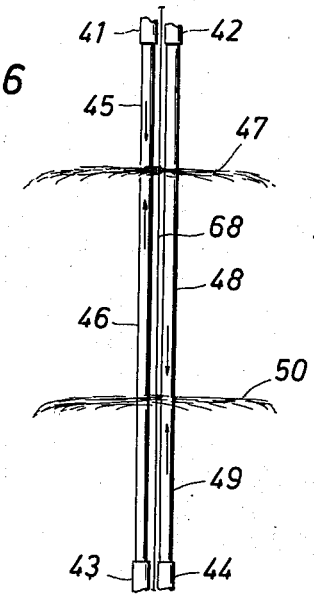
FIG. 6 is a simplified functional representation of a pair of closely adjacent oppositely projecting and colliding pairs of fluid streams.

Referring now to FIG. 6, there may be seen a simplified functional diagram of apparatus for producing two dispersals 47 and 50 which, in turn, may be moved backwards and forwards with respect to each other as desired. More particularly, it will be seen that the dispersal 47 is produced by the collision of stream 45, which issues from nozzle 41, colliding with stream 46 issuing from nozzle 43. Similarly, dispersal 50 results from the collision of stream 48, which issues from nozzle 42, colliding with stream 49 issuing from nozzle 44. Stream 48 is obviously of a higher velocity than stream 49, since its resulting dispersal 50 is located at a point nearer nozzle 44 than to nozzle 42. Similarly, stream 46 is obviously of a higher velocity than the velocity of stream 45, since its resulting dispersal 47 is located nearer nozzle 41 than to nozzle 43.

Referring again to FIG. 6, it will be noted that although dispersal 47 is unaffected by the fact that stream 48 passes through it, the close proximity of streams 45 and 46 to streams 48 and 49 will sometimes tend to cause migration therebetween, and perhaps even unwanted blending and diversion of one stream into another. This disadvantage of the present invention may be obviated by the provision of a suitable baffle such as a wire 68 extending therebetween, whereby and escaping particles of fluid will tend to cling to the wire 68 rather than to escape into the flow of any adjacent stream.

Referring now to FIG. 7, there may be seen a simplified pictorial representation of one type of decorative fountain 31 embodying the concept of the invention, wherein such fountain 31 may be seen to be comprised of a catch basin 32 or other type of sump, and a bracket 34 supporting a nozzle assembly 33 immediately above a second nozzle assembly 35 mounted in the center of the catch basin 32. More particularly, the nozzle assembly 33 may be seen to include three separate nozzles 33A-C arranged immediately above and in confronting relationship to three alternative nozzles 35A-C in the lower nozzle assembly 35. Accordingly, stream 36A, which issues from nozzle 33A, collides with stream 37A issuing from nozzle 35A to produce a dispersal 38. Stream 36B, which issues from nozzle 33B, collides with stream 37B from nozzle 35B to produce dispersal 39. In addition, stream 36C, which issues from nozzle 33C, collides with stream 37C from nozzle 35C to produce dispersal 40.

The apparatus depicted in FIG. 7 may, as may be seen therein, embody various of the different concepts hereinbefore discussed with respect to FIGS. 1–6. Accordingly, dispersal 38 is conical in configuration and derives from a collision point located closer to nozzle 33A than to nozzle 35A, because stream 37A is delivered at a higher velocity than its opposing stream 36A and because stream 36A is of a larger cross-sectional area than stream 37A. On the other hand, dispersal 40, which derives from a collision point nearer to nozzle 35C than to nozzle 33C, flares toward nozzle 33C because stream 36C is greater in velocity than stream 37C, although smaller in diameter. Again, dispersal 39, which is located mid-way of and derived from the collision of streams 36B and 37B, results from the fact that stream 36B is equal in velocity and cross-sectional area to stream 37B.

Referring again to FIG. 7, it will be noted that the various streams depicted therein are located in close proximity to each other. Accordingly, such an arrangement will preferably utilize baffles between the adjacent streams, as hereinbefore described with respect to FIG. 6.

Figure 8:
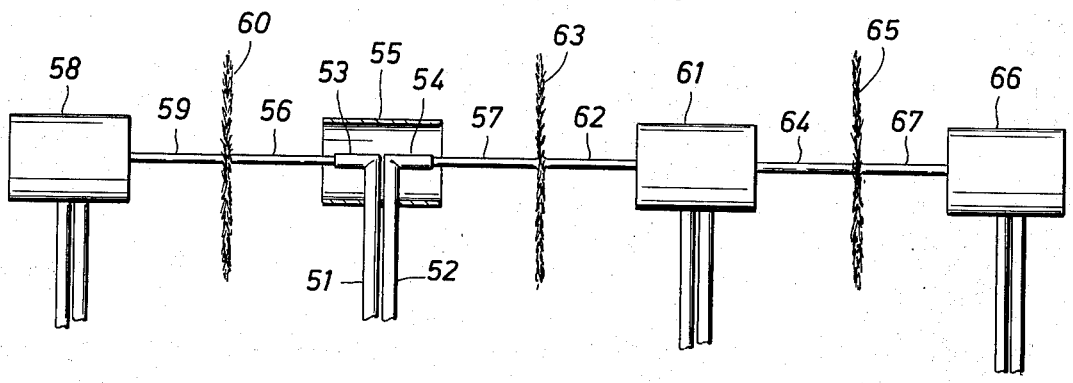
FIG. 8 is a simplified functional representation of another arrangement of a plurality of pairs of oppositely projecting and colliding fluid streams.

Referring now to FIG. 8, there may be seen an arrangement whereby a plurality of streams are all directed along or substantially along a common axis. More particularly, an array of oppositely directed L-shaped nozzles are provided whereby each nozzle ejects an opposing stream against an oppositely directed stream from another nozzle in order to produce a linear array of dispersals 60, 63 and 65. More particularly, it will be seen that conduits 51 and 52 connect with nozzles 53 and 54, respectively, to eject streams 56 and 57 in opposite directions to each other. Stream 56 collides with an opposing adjacent stream 59 to produce the radial dispersal 60. Stream 57, however, collides with adjacent stream 62 to produce the radial dispersal 63. Stream 62 is directed oppositely of its respectively adjacent stream 64, and stream 64 collides with its oppositely directed stream 67 to produce dispersal 65. As further indicated in FIG. 8, it may be desirable to surround each pair of nozzles with a shield. Hence, nozzles 53 and 54 are protected by shield 55, and shield 58 protects the nozzle which discharges stream 59. Similarly, shield 61 protects the nozzles producing streams 62 and 64, and shield 66 protects the nozzle producing stream 67 as well as another nozzle not specifically depicted therein.

Figure 10:
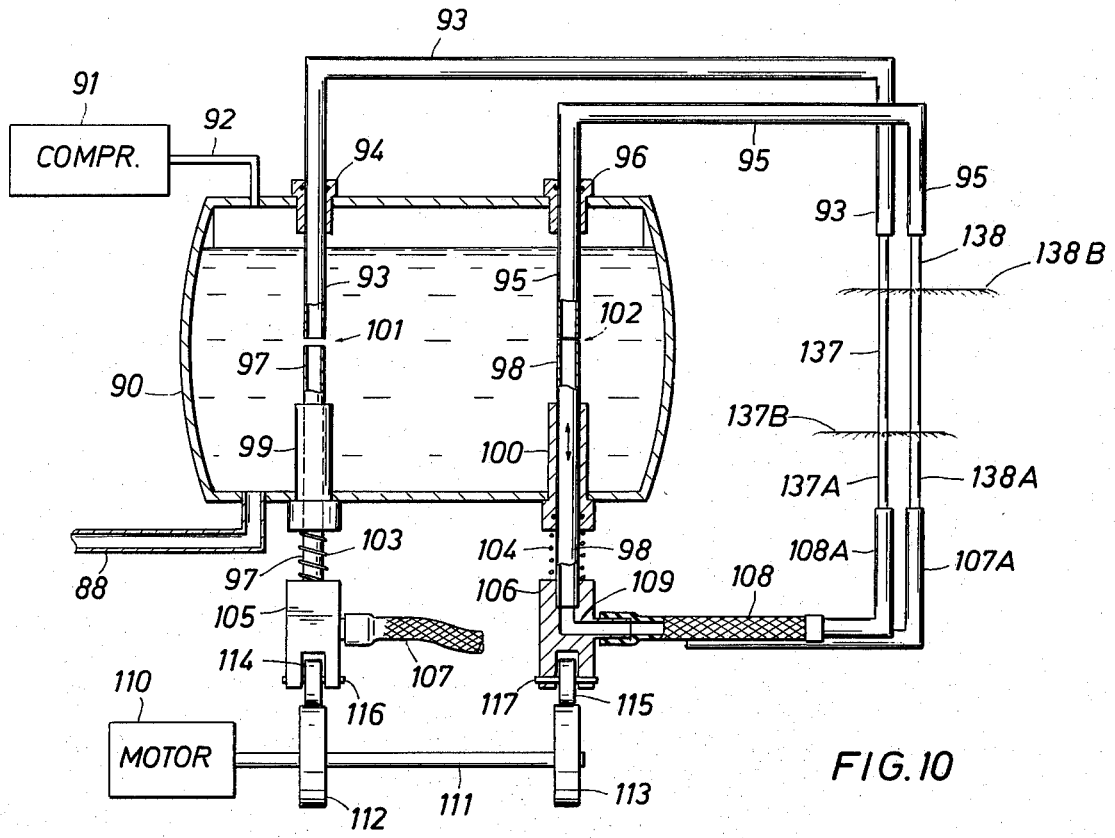
FIG. 10 is a simplified functional diagram of apparatus for providing and operating pairs of fluid streams according to the concept of the embodiment of the present invention exemplified in FIG. 7 and others.

Referring to FIG. 10, there may be seen a simplified pictorial representation, partly in cross section, of apparatus suitable for various uses including that of providing a decorative fountain such as hereinbefore described. More particularly, there may be seen a pressure tank 90 which receives water or other suitable fluid by way of an intake conduit 88, and which is also subjected to pneumatic pressure from a conventional compressor 91 and interconnected therewith by means of conduit 92. In this arrangement, a first fluid conduit 93 is inserted through the wall of the tank 90 by means of a fluid-tight fitting 94 and having one end arranged to provide a nozzle for producing a pressured stream 137. In addition, a second conduit 95 is inserted through the tank 90 by means of fitting 96 and has its outer end arranged as a nozzle to produce a stream 138. Stream 137 collides with stream 137A issuing from nozzle 108A to produce a dispersal 137B. Stream 138, in turn, collides with stream 138A issuing from nozzle 107A to produce dispersal 138B.

The purpose of the apparatus depicted in FIG. 10 is to provide illustrative means whereby the relative pressures of streams 137 and 137A and 138 and 138A may be varied according to preselected programs to cause the dispersals 137B and 138B to move backwards and forwards between oppositely confronting nozzles. It will be seen that conduits 93 and 95 are provided with intake and discharge openings of fixed diameter, whereby streams 137 and 138 will be constant in magnitude and velocity, assuming that the pressure in the tank 90 is maintained at an equal value. Accordingly it is the velocities of streams 137A and 138A which must be varied to cause the dispersals 137B and 138B to travel between the two sets of nozzles.

Referring again to FIG. 10, it will be seen that the apparatus also includes rigid conduits 97 and 98 which are slidably disposed in water-tight fittings 99 and 100, respectively, with their ends in close spacing relationship to the open ends of conduits 93 and 95. Conduit 97 is connected at its opposite end to a mount 105 having its interior coupled to a flexible conduit 107 which, in turn, is connected to the rigid conduit 107A. Conduit 98, in turn, is coupled to the interior of a mount 106 having its interior connected through a flexible conduit 108 to the rigid conduit or nozzle 108A. A coiled spring member 103 may be seen to be disposed about the conduit 97 between the fitting 99 and the mount 105, thus normally providing a gap 101 of maximum spacing between the abutting ends of conduits 93 and 97. Mount 105 may be seen to have a roller 114 supported in its opposite end by means of pin 116. Conduit 98 is connected at its outer end to the interior of another mount 106 which, in turn, has its interior coupled through a flexible hose 108 to the nozzle 108A. In addition, the mount 106 is similarly provided with a roller 115 by means of a suitable pin 117.

Accordingly, a motor 110 and drive shaft 111 may be provided with cams or program wells 112 and 113 which, in turn, are arranged in abutting relationship to the rollers 114 and 115. It is within the concept of this invention to provide for cam members 112 and 113 with either eccentric axes or suitably serrated rims, whereby rotation of the drive shaft 111 and cams 112 and 113 by the motor 110 will cause the mounts 105 and 106 to be cyclically urged into compressive tension with the springs 103 and 104. Accordingly, rotation of the shaft 111 will cause programmed closure and widening of the gaps 101 and 102 according to the configuration of the cam members 112 and 113, whereby the dispersals 137B and 138B will be caused to travel backwards and forwards between their respective pairs of nozzles.

Figure 11:
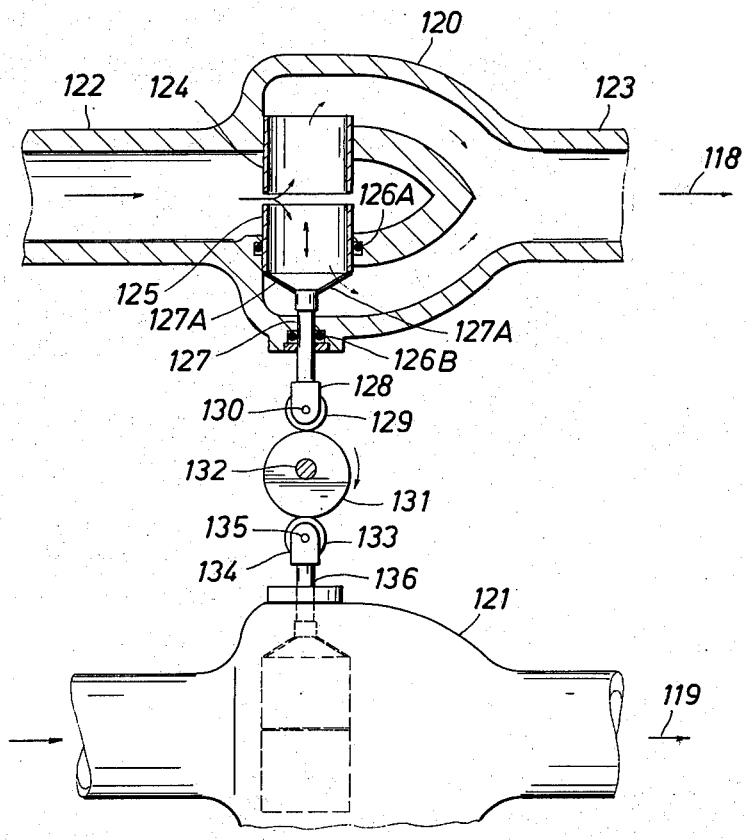
FIG. 11 is a simplified pictorial representation, partly in cross section, of another form of apparatus suitable for purposes of the present invention.

Referring now to FIG. 11, there will be seen a preferred embodiment of apparatus for varying the velocities of two opposing streams 118 and 119. More particularly, stream 118 may be seen to issue from a valve assembly 120 having an intake end 122 coupled to travel water or other fluid into both input ports of a forked outlet channel 123. The ports may be seen to be provided by the open ends of an abutting pair of orifice members 124 and 125. However, it will be seen that the orifice member 124 is fixedly positioned in the valve assembly 120, whereas the other orifice member 125 is slidably positioned therein in a fluid-tight manner by virtue of the gasket 126A and connected at its opposite end to a push rod 127 having one end connected to bracket 127A and having its other end coupled to a clevis member 128 supporting a pin 130 and roller 129. Valve assembly 120 is preferably located in proximity to a similar valve assembly 121, which also has a variable orifice (suggested but not depicted) arranged in abutting relationship to a fixed orifice (suggested but not depicted) and coupled to a push rod 136 which, in turn, supports a clevis member 134, roller 133 and pin 135. The two rollers 129 and 133 are preferably arranged in abutting relationship to a cam 131 mounted eccentrically on a rotatable cam shaft 132. Hence, when the cam shaft 132 rotates to revolve the cam 131, it will be seen that one of the two push rods 127 will be compressed while the other push rod 136 is released. Thus, stream 118 will be decreased in velocity while the opposite stream 119 will be increased in velocity. Alternatively, when the cam shaft 132 revolves so as to cause the cam member 131 to revolve and release pressure on the cam shaft 127, this in turn will apply pressure to the roller 133 to drive the push rod 136 so as to close its respective movable orifice member into abutting relationship to its fixed orifice member. It will be apparent that when the spacing between orifices 124 and 125 is small, this will reduce the amount of water available for discharge as stream 118. However, since the size of the discharge port 123 is not changed, the result will be that the water composing stream 118 will be discharged at a lower velocity. Accordingly, rotation of the cam shaft 132 and cam 131 will alternately increase and decrease the relative difference between the velocities of the two streams 118 and 119 to thereby travel the dispersed (not depicted) produced by the collision with each other.

Figure 12:
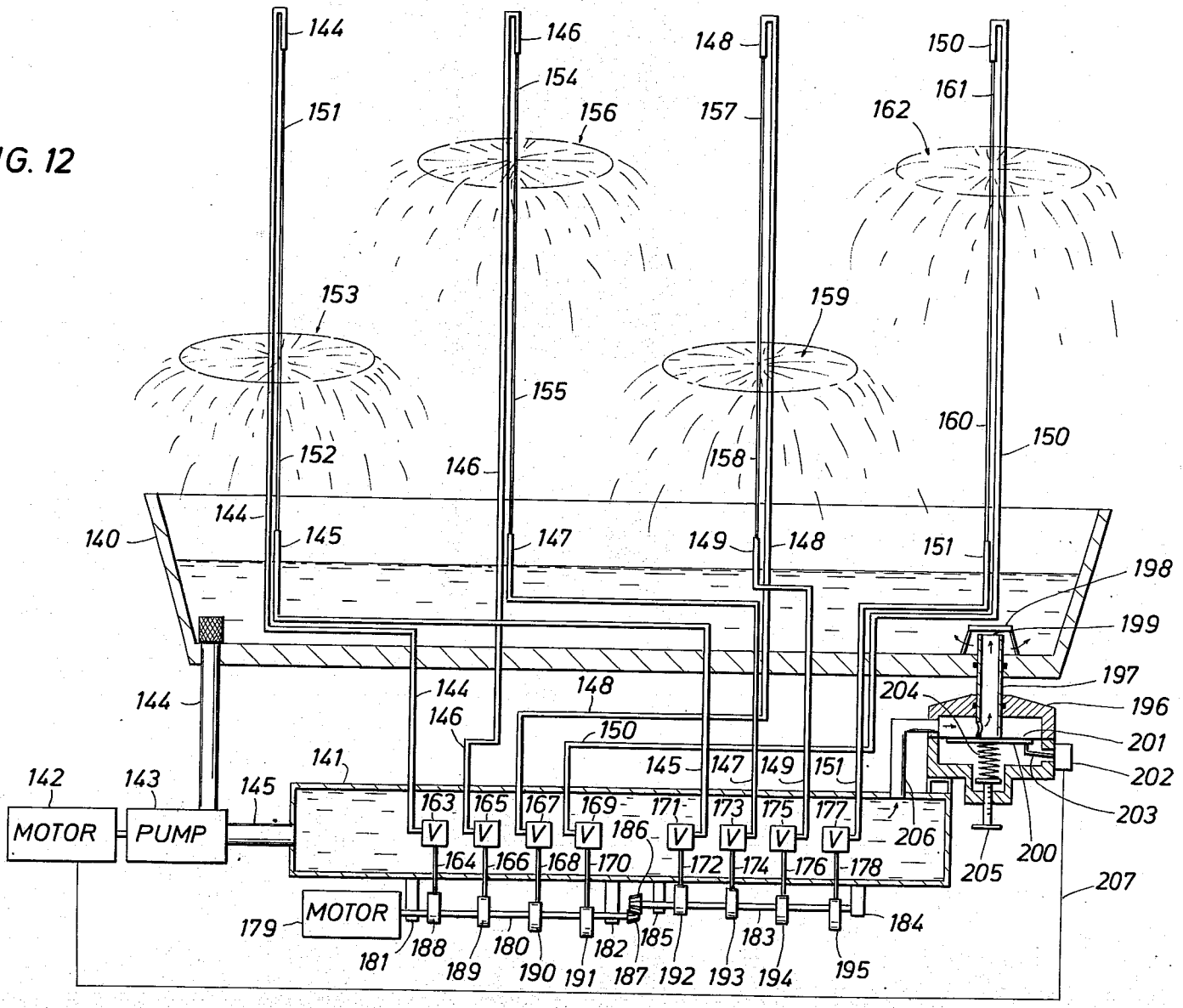
FIG. 12 is a simplified pictorial representation of another form of decorative fountain embodying the concept of the present invention.

Referring now to FIG. 12, there may be seen a more detailed pictorial representation, partly in cross section, of a decorative fountain or other apparatus having provision for more complex programming of a plurality of different dispersals 153, 156, 159 and 162. More particularly, the equipment may be seen to include a suitable sump or catch basin 140 and a motor 142 for driving a pump 143 which accepts water from the catch basin 140 by way of conduit 144 and travels such water through a conduit 145 to a pressure tank 141. There may be seen in pressure tank 141 a plurality of cam actuated valves 163, 165, 167, 169, 171, 173, 175 and 177. Valve 163, which is actuated by push rod 164, is connected to deliver water at a varying velocity through conduit 144 to provide directed stream 151. Valve 171, which is actuated by push rod 172, delivers water from the pressure tank 141 through conduit 145 to provide upwardly directed stream 152. Streams 151 and 152, in turn, collide to form the dispersal 153. Valve 165, which is actuated by push rod 166, is coupled through conduit 146 to provide the downwardly directed stream 154. Valve 173, which is actuated by push rod 174, delivers water from the pressure tank 141 through conduit 147 to provide the upwardly directed stream 155 which, in turn, collides with stream 154 to produce dispersal 156.

Valve 167, which is actuated by push rod 168, delivers water from the pressure tank 141 through conduit 148 to provide the downwardly directed stream 157. Valve 175, which is actuated by push rod 176, delivers water from the pressure tank 141 through conduit 149 to produce the upwardly directed stream 158 which, in turn, collides with stream 157 to produce the dispersal 159. Valve 169, which is actuated by push rod 170, delivers water from the pressure tank 141 through conduit 150 to provide the downwardly directed pressured stream 161. Valve 177, which is actuated by push rod 178, delivers water from the pressure tank 141 through conduit 151 to provide the stream 160 which, in turn, collides with stream 161 to provide the dispersal 162. The various push rods may be seen to be actuated by an assembly of cams mounted on cam shafts 180 and 183 which, in turn, are supported by brackets 181–182 and 184–185. Cam shaft 180 is preferably rotated by the motor 179 and has a pinion gear 187 on its outer end. Cam shaft 183 preferably has a pinion gear 186 at one end and engaged with the pinion gear 187 or cam shaft 180. Accordingly, rotation of cam shaft 180 by the motor 179 will, in turn, appropriately rotate cam shaft 183.

It will be apparent that push rod 164 is actuated by rotation of cam 188, and push rod 166 is actuated by rotation of cam 189. Push rod 168 is actuated by rotation of cam 190, and push rod 170 is actuated by rotation of cam 191. Similarly, push rods 172 and 174 are actuated by rotation of cams 192 and 193, respectively, and push rods 176 and 178 are actuated by rotation of cams 194 and 195. It will thus be apparent that the configuration of the various cams will determine the sequence followed by the various dispersals depicted. It should be noted that the size of the various dispersals 153, 156, 159 and 162 are a function of the pressure within the tank 141. Accordingly, it is desirable to maintain a preselected in order to prevent variations in the dispersal size, and this is preferably accomplished by means of a pressure regulator 196 such as depicted in FIG. 12. More particularly it will be seen that water from within tank 141 is coupled into the upper portion of the regulator 196 by means of a conduit 206 to provide a pressure against a diaphragm 201 equal to the pressure within the tank 141. The diaphragm 201 is preferably secured to the lower end of a rigid conduit 197 which is slidably mounted through the wall of the catch basin 140 with one end open to receive water and pressure from conduit 206, and with its upper end positioned to define a gap 199 with respect to a fixed baffle 198. The diaphragm 201 is also preferably fastened to a rigid plate member 200 which, in turn, is disposed in abutting relationship with a spring member 204. An adjustment means is preferably provided, such as a thumb screw 205 or the like, for applying a preselected compression on the spring member 204 which is equal to the pressure sought to be maintained in the tank 141. Accordingly, if the pressure in tank 141 exceeds the pressure level sought to be maintained, this pressure within the regulator 196 will depress the diaphragm 201 and plate member 200 against the spring member 204. Alternatively, if the pressure in tank 141 is less than the pressure level sought to be maintained, the compressive tension applied to the spring member 204 by the setting of the thumb screw 205 will force the plate member 200 and diaphragm 201 upwardly within the regulator 196. Accordingly, an excessive pressure in the tank 141 will widen the gap 199 to increase fluid flow from the pressure tank 141 into the catch basin 140, until the pressure within the pressure tank 141 drops to the level sought to be achieved and maintained. Alternatively, a decrease in pressure within the tank 141 will permit the spring 204 to close the gap 199, thereby reducing or terminating fluid flow from the tank 141 into the catch basin 140.

Referring again to the pressure regulator 196, it will be noted that there may also be provided a conventional limit switch 202 or the like having a leaf-type actuator 203 disposed in abutting relationship to the plate member 200. Accordingly, if the diaphragm 201 is forced downwardly against the spring 204 by an excess of pressure within tank 141, the actuator 203 will open switch 202 and thereby disconnect power leading to the motor 142 by way of connector 207. Alternatively, if the pressure within tank 141 drops below the level sought to be maintained, and if the spring 204 thereafter forces the plate member 200 and diaphragm 201 upwardly within the pressure regulator 196, this will permit the actuator 203 to close switch 202 and thereby actuate the motor 142. Actuation of the motor 142 will, of course, deliver water 145 into the tank 141 and thereby increase the pressure level therein. Alternatively, if the motor 142 is inactivated, the pressure within the tank 141 will continue to discharge water through the various conduits to form the dispersals 153, 156, 159 and 162 until the pressure in the tank 141 drops to the level sought to be maintained.

Figure 9:
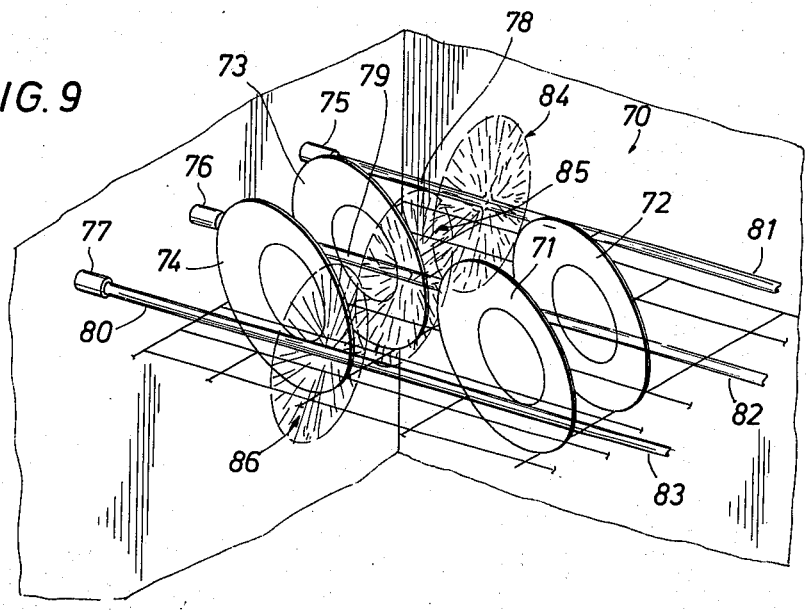
FIG. 9 is a simplified pictorial representation of dish washing apparatus or the like employing oppositely projecting and colliding fluid streams according to the concept of the present invention.

Although the utility of the present invention has been heretofore discussed principally with respect to decorative-type fountains, it should be understood that the term "fountain" covers any means for discharging a spurt or jet of water or other fluid, and that the present invention will therefore have many useful applications. Referring now to FIG. 9, there may be seen a simplified embodiment of the present invention wherein the concept is employed for the purpose of an automatic dishwater. More particularly, it will be seen that the interior chamber 70 of an otherwise conventional dishwasher may be provided with racks for holding a plurality of dishes 71–74, and that nozzles 75–77 may be provided for the purpose of projecting pressured streams 78–80 in between the dishes 71–74. In addition, opposing streams 81–83 are provided by other similar nozzles (not specifically depicted) to collide with respective ones of the streams 78–80 and to thereby provide for dispersals 84–86. Means such as hereinbefore discussed may be included in such an arrangement for the purpose of traveling the dispersals 84–86 backwards and forwards across the various surfaces on the dishes 71–74 for the purpose of enhancing the scouring effect achievable with the dispersals 84–86. In addition, other means may be provided for imparting different configurations to the dispersals 84–86, as hereinbefore discussed in detail.

It will readily be apparent that various modifications and alternations may be employed. For example, the decorative effect obtainable with apparatus such as depicted in FIGS. 6–8 may be enhanced by the use of streams of different types or colors of fluids, and the dancing effect achieved by moving the different dispersals may be accompanied by music or by moving light displays. Similarly, the dishes 71–74 may be washed as well as rinsed by providing alternate streams of detergent as well as rinse water.

It will be apparent from the foregoing that many other variations and modifications may be made in the structures and methods described herein without substantially departing from the essential concept of the present invention. Accordingly, it should be clearly understood that the forms of the invention described herein and depicted in the accompanying drawings are exemplary only are not intended as limitations in the scope of the present invention.

What is claimed is:

1. A fountain comprising first discharge means for forming and directing a first cylindrical jet of substantially non-aerated stream of liquid in one direction and generally along a first preselected axis, second discharge means for forming and directing a second cylindrical jet of substantially non-aerated stream of liquid in the opposite direction and generally along a second preselected axis to collide with said first jet of liquid for producing a substantially non-aerated dispersal having a substantially circular configuration tranversing and concentrically located on said axes, and control means for positioning said dispersal at a preselected location intermediate of said discharge means.

2. The fountain described in claim 1, wherein said control means in interconnected with said discharge means to travel said dispersal along said axes between said first and second discharge means.

3. The fountain described in claim 2, wherein said control means oscillates and dispersal along said axes between and alternately to and from said first and second discharge means.

4. The fountain described in claim 3, wherein said discharge means are arranged in confronting alignment to deliver first and second jets having substantially equal cross sections and producing a radial liquid dispersal having a disc-like configuration perpendicular of and centered on said axis.

5. The fountain described in claim 3, wherein said first discharge means forms said first jet with a cross section larger than that of said second jet to produce a dispersal having a generally conical configuration functionally related to the difference between such cross sections.

6. The fountain described in claim 3, wherein said first axis is parallel to and spaced from said second axis whereby said jets collide to produce a dispersal traversing said axes at an angle functionally related to the spacing between said axes.

7. A fountain comprising a first pair of discharge means arranged in generally confronting relationship to form a first pair of oppositely directed cylindrical jets of substantially non-aerated-liquid colliding to produce a first substantially non-aerated dispersal of liquid located intermediate of said first pair of discharge means and having a circular configuration concentrically positioned with respect to said first pair of jets.

a second pair of discharge means also arranged to generally confronting relationship to form a second pair of oppositely directed cylindrical jets of substantially non-aerated liquid spaced from and parallel with said first pair of jets of liquid and also colliding to produce a second substantially non-aerated dispersal of liquid located intermediate of said second pair of discharge means and having a circular configuration concentrically positioned with respect to said second pair of jets, and control means for positioning said first and second dispersals at preselected locations intermediate said discharge means.

8. The fountain described in claim 7, wherein said control means is interconnected to position said first dispersal as a function of any difference between the velocities of said first pair of jets and said second dispersal as a function of any difference between the velocities between said second pair of jets.

9. The fountain described in claim 7, wherein said control means is interconnected to regulate the configuration of said dispersal as a function of any difference in cross section between the cross sections of said first pair of jets and the configuration of said second dispersal as a function of any difference between the cross sections of said second pair of jets.

10. The fountain described in claim 7, wherein said control means is further interconnected to regulate the angular position of said first dispersal as a function of any difference in alignment of said first pair of discharge means and the angular position of said second dispersal as a function of any difference in alignment of said second pair of discharge means.

11. The fountain described in claim 7, wherein said discharge means are also arranged to align said first pair of jets in close proximity to said second pair of jets, and wherein said fountain further includes baffle means aligned with said first and second pairs of jets to intercept liquid migration therebetween.

12. A method of establishing and positioning a free traveling circular and substantially non-aerated dispersal of liquid, comprising forming and aiming a first substantially cylindrical jet of substantially non-aerated liquid in one direction along a first preselected axis, forming and aiming a second substantially cylindrical jet of substantially non-aerated liquid in the opposite direction along a second preselected axis parallel with said first axis to collide with said first jet and produce said dispersal, and discharging said jets at velocities to position said dispersal at a preselected location along said axes.

13. The method described in claim 12, including the step of adjusting the discharge velocities of said jets with respect to each other to travel said dispersal along said axes.

14. The method described in claim 13, including forming said jets with substantially equal cross sectional areas to provide said dispersal with a radial configuration concentrically located on said axes.

15. The method described in claim 13, including forming one of said jets with a greater cross sectional area to provide said dispersal with a conical configuration flared toward the other of said jets.

16. The method described in claim 14, wherein said axes are misaligned with respect to each other to produce a radial dispersal tilted on said axes at an angle functionally related to the magnitude on such misalignment.

17. Flow regulating apparatus comprising housing means for supporting and passing a flow of liquid and having an inlet port and outlet port, a first conducting member disposed in said housing and having an intake aperture for receiving a first portion of said flow of liquid from said inlet port and an exit aperture for discharging said received portion to said outlet port, a second conducting member disposed in said housing and having an intake aperture for receiving a second portion of said flow of liquid from said inlet port and an exit aperture for discharging said second portion to said outlet port in comminglement with said first portion of said flow, said second conducting member further being disposed in said housing with its intake port confronting and engageable with said intake port of said first conducting member for restricting and interrupting flow of liquid through said members, and adjustment means interconnected with said second conducting member for establishing spacing between said intake ports of said conducting members.

18. The regulating apparatus described in claim 16, wherein said first conducting member is fixedly positioned in said housing means and said second member is slidably movable in said housing to and from said first conducting member.

* * * * *

UNITED STATES PATENT OFFICE

CERTIFICATE OF CORRECTION

Patent No. 4,002,293 Dated January 11, 1977

Inventor(s) Thomas R. Simmons

It is certified that error appears in the above-identified patent and that said Letters Patent are hereby corrected as shown below:

Column 4, line 42, "srream" should be --stream--.

Column 8, line 57, insert --downwardly-- between "provide" and "directed".

Column 9, line 38, insert --pressure-- between "preselected" and "in"

Column 10, lines 38 and 39, "dishwater" should be -- dishwasher --

Column 11, line 20, "tranversing" should be --traversing--.

Column 11, line 30, between "oscillates" and "dispersal" delete "and" and insert --said--.

Column 12, line 12 insert --first-- between "said" and "dispersal"

Signed and Sealed this

Tenth Day of May 1977

[SEAL]

*Attest:*

RUTH C. MASON
*Attesting Officer*

C. MARSHALL DANN
*Commissioner of Patents and Trademarks*